United States Patent [19]

Elsas

[11] 4,351,073

[45] Sep. 28, 1982

[54] SAFETY NET FOR LAVATORY

[75] Inventor: Norman E. Elsas, Atlanta, Ga.

[73] Assignee: Nemo Industries, Inc., Atlanta, Ga.

[21] Appl. No.: 208,689

[22] Filed: Nov. 20, 1980

[51] Int. Cl.[3] ..... A47K 1/06; A47L 19/02

[52] U.S. Cl. ..... 4/654; 4/655; 4/656; 4/661

[58] Field of Search ..... 4/661, 656, 655, DIG. 18, 4/657, 658, 650, 642, 652, 640, 639, 286, 292, 290, 291

[56] References Cited

U.S. PATENT DOCUMENTS

| | | | |
|---|---|---|---|
| 57,284 | 8/1866 | Bryant | 4/656 |
| 758,770 | 5/1904 | McCann | 4/655 |
| 815,855 | 3/1906 | McAdams | 4/656 |
| 916,283 | 3/1909 | Eccleston | 4/656 |
| 1,368,591 | 2/1921 | Windsor | 4/655 X |
| 1,653,000 | 12/1927 | Capra | 4/656 |
| 2,147,805 | 2/1939 | Windsor | 4/655 |
| 2,806,227 | 9/1957 | Arbetter | 4/DIG. 18 |

*Primary Examiner*—Henry K. Artis
*Attorney, Agent, or Firm*—James B. Middleton

[57] ABSTRACT

A safety net for use with a lavatory to catch small items inadvertently dropped into the lavatory. The safety net includes a piece of net material sized to extend completely across the lavatory bowl in both directions and to allow the net material to conform somewhat to the bowl. Rather rigid end pieces are fixed to the net material to hold the net in place. The end pieces may be hinged to allow the safety net to be folded.

4 Claims, 4 Drawing Figures

SAFETY NET FOR LAVATORY

FIELD OF THE INVENTION

This invention relates generally to safety nets, and is more particularly concerned with net means for catching and retaining items inadvertently dropped into a lavatory or the like.

BACKGROUND OF THE INVENTION

In most households, the bathroom lavatory is used for rinsing or cleaning numerous items, and frequently for cleaning small items such as small pieces of jewelry, removable teeth, and contact lenses, to name only a few. The problem encountered in such washing is the hazard of dropping a small item. Since such small items are frequently rinsed generously with the drain open, there is an imminent danger of losing the item down the drain. While some heavier items may lodge in the trap and be retrievable (through with some difficulty), other items might well pass entirely through the trap so that they are, for practical purposes, irretrievable. This is especially true of such items as contact lenses which are made of plastic and are light enough to be carried through traps and the like by even a small current of water.

One possible solution to the above stated problem is simply to close the drain of the lavatory. Such a solution is not really acceptable since the lavatory will fill with water after a certain amount of rinsing; furthermore, if the basin is filled with water a contact lens would be difficult to find because of the small differences in the refractive indexes of the lenses and the water. Another possible solution is the use of a strainer over the drain sufficiently fine to prevent passage of items dropped into the lavatory. While such a solution will be acceptable for special purpose lavatories and basins, it would not be acceptable in a conventional household lavatory that is used for diverse purposes. Additionally, the removal of the conventional drain plug and the installation of a fine strainer would be excessively expensive as a means to solve an infrequently recurring problem.

SUMMARY OF THE INVENTION

The present invention overcomes the above mentioned and other difficulties with the prior art by providing a safety net for use in conjunction with a lavatory, and including flexible net means disposable beneath the water faucet and generally conformable to the lavatory bowl, the safety net further having generally rigid end members for disposition beyond the bowl to support the ends of the net. The safety net of the present invention is therefore useable with virtually any lavatory, sink or wash basin and provides a porous catching means disposable above the bottom of the bowl while generally extending the full width and length of the bowl to receive any items that may be dropped into the bowl. The generally rigid end means may also be foldable to allow the safety net of the present invention to be folded and stored in a small space.

BRIEF DESCRIPTION OF THE DRAWINGS

These and other features and advantages of the present invention will become apparent from consideration of the following specification when taken in conjunction with the accompanying drawings in which.

DESCRIPTION OF AN EMBODIMENT OF THE INVENTION

Figure 1:
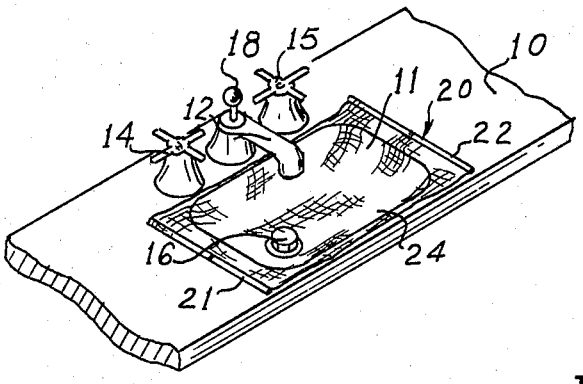
FIG. 1 is a perspective view showing a safety net in conjunction with a lavatory in accordance with the present invention.

Referring now more particularly to the drawings, and to that embodiment of the invention here chosen by way of illustration, it will be seen in FIG. 1 of the drawings that there is a counter top 10 having a lavatory 11 mounted therein. The water faucet 12 and water controls 14 and 15 are mounted adjacent to the lavatory 11. Those skilled in the art will realize that this constitutes a generally conventional arrangement for household bathrooms and the like. It will also be seen that there is a drain 16 at the bottom of the lavatory 11, the drain plug being controlled by the knob 18.

FIG. 1 also discloses a safety net generally designated at 20, the safety net 20 including end members 21 and 22 with the net material 24 extending therebetween. It will be noticed in FIG. 1 that the net material 24 extends beneath the water faucet 12, conforms somewhat to the lavatory bowl and extends to the front edge of the bowl, generally held in place by the end members 21 and 22.

Figure 2:
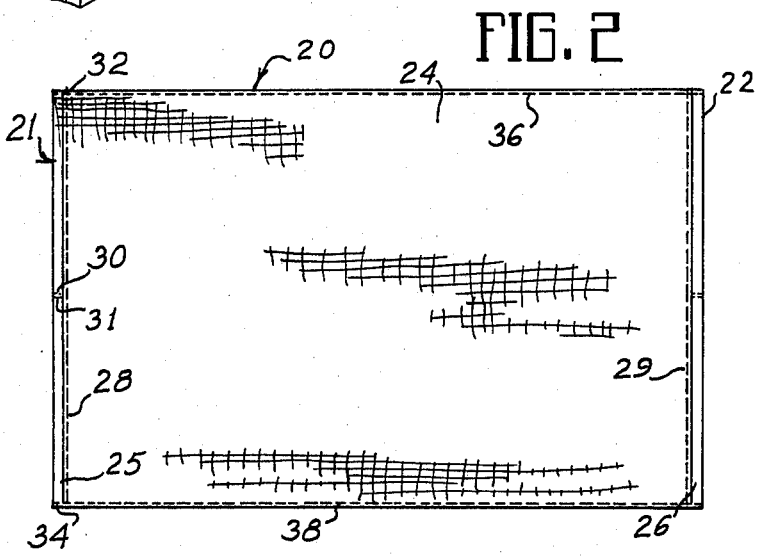
FIG. 2 is a top plan view of a safety net made in accordance with the present invention.

In FIG. 2 of the drawings it will be seen that the safety net 20 has the net material 24 of a generally rectangular configuration, and the end members 21 and 22 are placed in the shorter edges of the rectangle.

At this point, it should be understood that many different forms of material may be used as the net material 24, the criteria being flexibility and porosity, or openness of the weave or knit. Such fabrics as cheese cloth or the like may be satisfactory for some applications, and numerous other fabrics will suggest themselves to those skilled in the art. It has been found, however, that the well known nylon net is highly desirable in that it has sufficient strength whether wet or dry, the openings in the net are sufficiently small to catch contact lenses, small pieces of jewelry and the like. Nylon netting also has the advantage of being a thermoplastic so that seams, hems and the like can be heat sealed if desired. Thus, in the following specification, the seams and hems should be interpreted as either sewn or heat sealed or otherwise fastened by various means known to those skilled in the art.

Returning now to FIG. 2 of the drawings, it will be seen that each end of the net material 24 is provided with a hem such as the hems 25 and 26, the hems being fixed by a seam such as the seams 28 and 29. Generally centrally of the hems 25 and 26 there are transverse seams such as the seams 30 and 31, and end seams 32 and 34. The end seams 32 and 45 may be coextensive with the seams 36 and 38 which extend the full length of the net material 24. Though nylon net does not necessarily have to be hemmed since it will not ravel, the seams 36 and 38 may be desirable for appearance, or may be necessary on some fabrics that may be utilized as the net material 24. Of course the seams 36 and 38 may be omitted if preferred.

Figure 3:
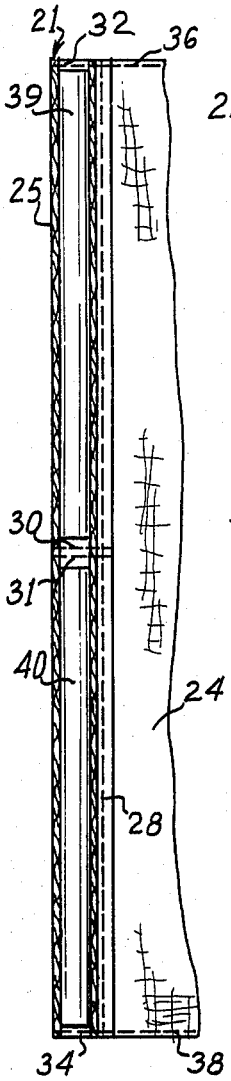
FIG. 3 is an enlarged cross-sectional view of one end of the net shown in FIG. 2, most of the net being broken away; and, FIG. 4 is an enlarged end elevational view of the net shown in FIGS. 2 and 3.

Attention is next directed to FIG. 3 of the drawings which shows the end member 21 in greater detail. In FIG. 3 it will be seen that the hem 25 is in cross-section to expose the rigid rods 39 and 40. Again, it will be understood that numerous materials may be used as the rods 39 and 40, but a very desirable material is a plastic such as polystyrene, polyethylene or other plastic that can be made in generally rigid form since these are generally not affected by water, detergents and the like. While wooden rods may be used, wood may be affected by continual wetting and may not be quite as desirable.

As is shown in FIG. 3 of the drawings the rods 39 and 40 are two separate rods, the rods being within the hem 25 and maintained separate by the seams 30 and 31; however, the rods are held within the hem 25 by the seams 32 and 34. Thus, the two sections of the hem 25 are generally rigid, but the hem is hinged, or bendable, generally centrally thereof at the seams 30 and 31.

It will be understood that the end member 22 is constructed the same as end member 21 so no detailed description of the end member 22 is thought to be necessary.

Figure 4:
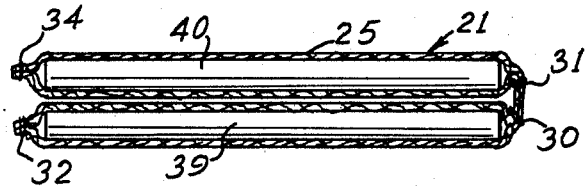

Looking next at FIG. 4 of the drawings, the hinging, or folding, of the device is illustrated. It will be seen that the seams 30 and 31 maintain sufficient separation between the rods 39 and 40 that the rods 39 and 40 can be hinged with respect to each other to allow the safety net 20 to be folded in half longitudinally. It will be understood that, if the rods 39 and 40 were crowded close together, the flat abutting ends would tend to prevent folding of the device. While other forms of hinge members may be used, the use of the two separate rod members 39 and 40 separated by means of the seams 30 and 31 provides an extremely simple and inexpensive hinge means to allow folding of the safety net 20.

One simple and inexpensive way to provide for the hinge is to be sure that the hem such as the hems 25 and 26 are just large enough to receive the rods such as the rods 39 and 40. The important feature is that the rods cannot be positioned beside each other within the hem. Then, with rounded adjacent ends on the rods 39 and 40, it will be understood that the end piece such as the end piece 21 will always be foldable, since the two rods will urge each other apart, while the end seams 32 and 34 will retain the rods within the hem.

From the foregoing description, it should be understood that the safety net 20 will be made of nylon net or other thin and flexible material so that it can be folded into a small space. When one is to wash contact lenses, small pieces of jewelry or the like, the safety net can be unfolded, the end members 21 and 22 can be unfolded to provide generally straight rod members at each end of the net material 24, and the end members 21 and 22 can be simply placed at each side of the lavatory 11. The net material 24 can be placed beneath the water faucet 12, the material being sufficiently flexible to achieve this regardless of the configuration of the water faucet 12 and other controls. The material 24 can then be pushed into the lavatory bowl generally to conform to the shape of the bowl but remaining above the drain 16. In this condition it will be seen that the water faucet 12 and the controls 14 and 15 can be freely used without interference from the safety net 20; however, any small item dropped into the lavatory will be captured by the net material 24 so that it can be readily retrieved.

If the lavatory is not mounted in a counter as shown in the drawings, the end members 21 and 22 can be draped over the sides of the lavatory, and will effectively hold the safety net in place. Thus the safety net of the present invention is highly versatile.

When one is through with the safety net 20, it can be folded in half longitudinally, and rolled or folded transversely to be a very small package that will fit into a pocketbook, coat pocket, suitcase or the like.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. In a lavatory including a bowl having a bottom, a water faucet, and controls for selectively causing water to flow through the water faucet and into said bowl, the combination therewith of a safety net receivable beneath said water faucet and above said bottom and extendable completely across said bowl from front to back thereof, said safety net further being extendable completely across said bowl from one side to the other, said safety net comprising flexible, porous material, and including generally rigid end members for retaining the said safety net in place, the arrangement being such that said flexible, porous material generally covers said bowl with said end members at the top of said bowl, said flexible, porous material extending into said bowl below said faucet to allow an object to be rinsed and above said bottom for allowing water flow through said flexible, porous material and into said bowl.

2. The combination as claimed in claim 1, said flexible, porous material including generally rectangular net material, each end member of said end members being fixed to one end of said net material, each end member of said end members including a hem in said one end of said net material, a first rod member within said hem and extending from the rear edge generally to the longitudinal center of said net material, a second rod member within said hem and extending from the front edge generally to the longitudinal center of said net material.

3. The combination as claimed in claim 2, and including hinge means for hinging said end members.

4. The combination as claimed in claim 3, and further including transverse seams generally at said rear edge of said hem and generally at said front edge of said hem for retaining said rod members within said hem, and including at least one center transverse seam for maintaining said rod members separated, said at least one center transverse seam constituting said hinge means.

* * * * *